US006066002A

United States Patent [19]

Sterckx et al.

[11] Patent Number: 6,066,002

[45] Date of Patent: May 23, 2000

[54] SHIELDED PLUG CONNECTOR

[75] Inventors: Rik Sterckx, Oostkamp; Georges Embo, Langemark, both of Belgium

[73] Assignee: Siemens Aktiengesellschaft, Munich, Germany

[21] Appl. No.: 09/225,098

[22] Filed: Jan. 4, 1999

Related U.S. Application Data

[63] Continuation of application No. PCT/DE97/01378, Jul. 1, 1997.

[30] Foreign Application Priority Data

Jul. 2, 1996 [DE] Germany ..... 196 26 629

[51] Int. Cl.[7] ..... H01R 13/648

[52] U.S. Cl. ..... 439/607

[58] Field of Search ..... 439/607, 608, 439/609, 567, 571, 541.5

[56] References Cited

U.S. PATENT DOCUMENTS 5,865,645 2/1999 Embo et al. ..... 439/567

FOREIGN PATENT DOCUMENTS 43 29 151 A1 3/1994 Germany .

*Primary Examiner*—Steven L. Stephan
*Assistant Examiner*—Eugene G. Byrd
*Attorney, Agent, or Firm*—Herbert L. Lerner; Laurence A. Greenberg; Werner H. Stemer

[57] ABSTRACT

The plug connector has a metallic shield cage which is composed of an integral sheet-metal part having a lead-in plate, a cover wall and sidewalls which are bent through 90° away from the cover wall and extend to the printed circuit board. The insulating body of the plug connector and its contacts are held completely in the shield cage and, shielded all round, are held in a fixed position between the printed circuit board and the shield cage.

11 Claims, 4 Drawing Sheets

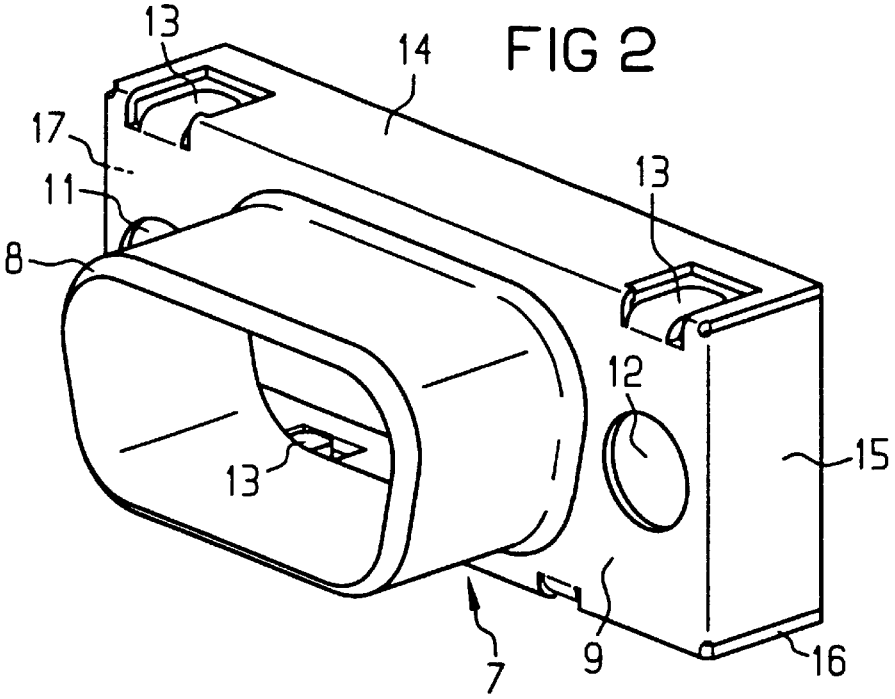
FIG 2
FIG 3
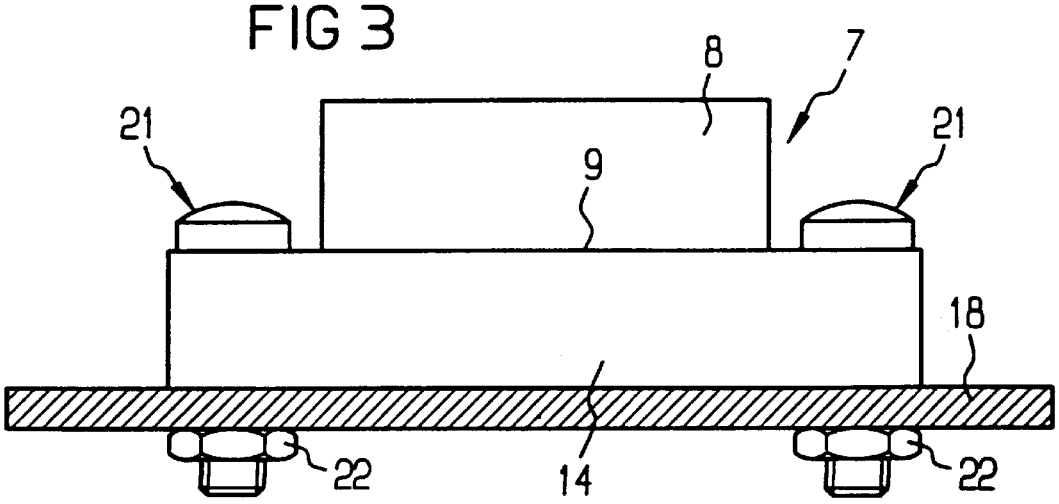

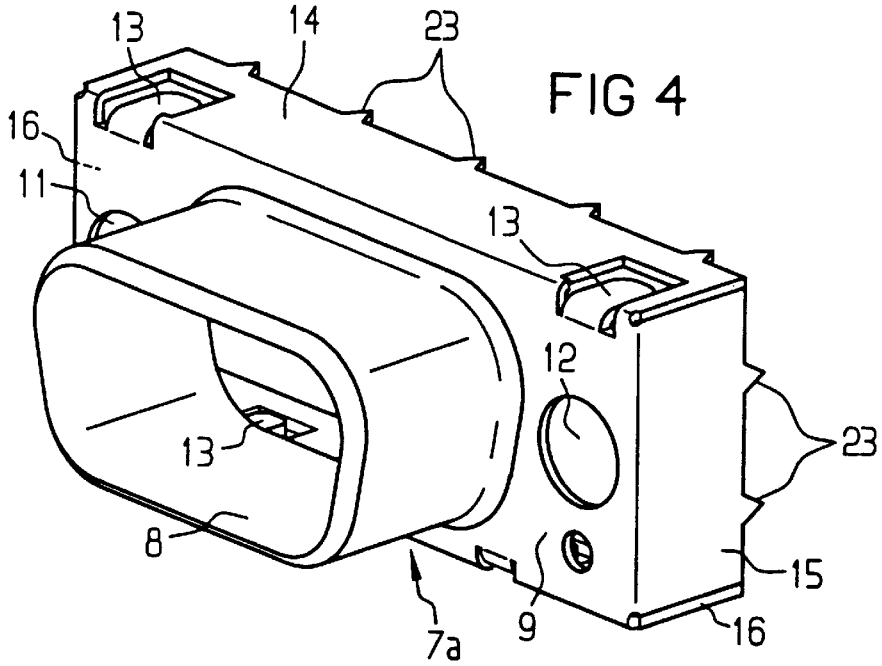
FIG 4
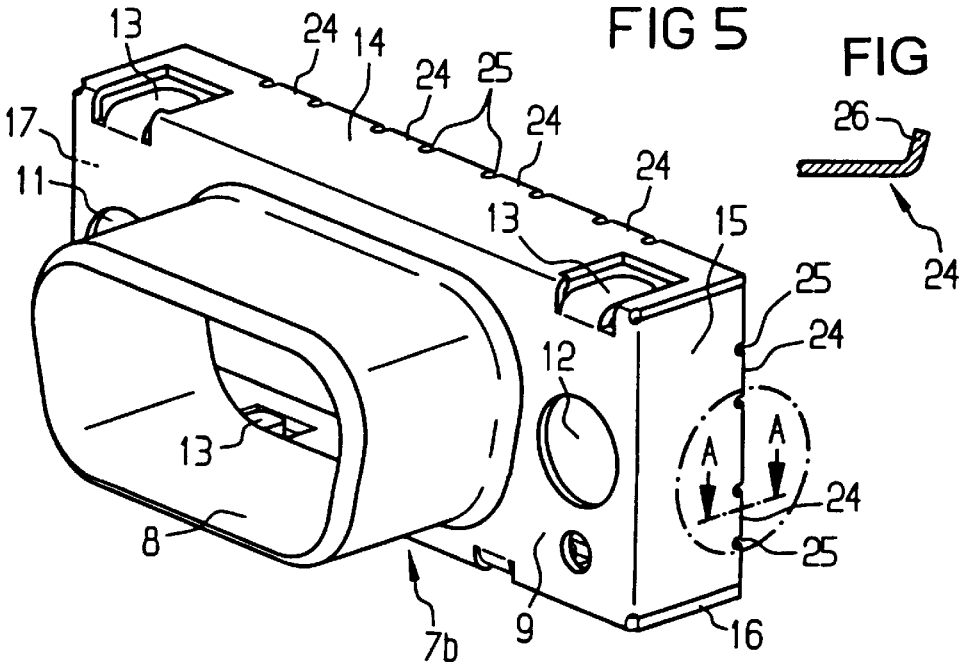
FIG 5
FIG 5A

SHIELDED PLUG CONNECTOR

CROSS-REFERENCE TO RELATED APPLICATION

This is a continuation of copending international application PCT/DE97/01378, filed Jul. 1, 1997, which designated the United States.

BACKGROUND OF THE INVENTION

FIELD OF THE INVENTION

The invention relates to a SUB-D plug connector with shielding for installation at right angles to a printed circuit board. The plug connector is formed with a single-piece or multi-piece insulating body holding contacts and with a metallic shield cage that encloses the insulating body. The plug connector further has a turret-like lead-in plate produced by deep-drawing and, on the end of the lead-in plate facing away from the insertion side, a planar cover wall.

A plug connector of that type has become known, heretofore, from German published patent application DE 43 29 151 A1. There, the SUB-D plug connector has a two-piece insulating body in which the contact springs are held. In order to shield the plug connector, a lead-in plate with a cover wall is pushed onto the outer insulating body, whereby the two insulating bodies are clipped together by means of sheet-metal lugs which are integrally formed on the cover wall. In order to comply with more stringent shielding requirements, the shielding is designed as a metallic shield cage which has two identical, side sheet-metal parts, whose bent-around edges are mounted between the lead-in plate and the two parts of the insulating body, and are clipped to one another at the sides. The shielding plates extend to the printed circuit board and may be provided, at that end, with push-in pins for attachment to the printed circuit board.

SUMMARY OF THE INVENTION

It is accordingly an object of the invention to provide a shielded plug connector, which overcomes the above-mentioned disadvantages of the heretofore-known devices of this general type and which has electrically and magnetically conductive shielding surrounding it on all sides, and, at the same time and primarily, is simplified in terms of the construction of the shielding.

With the foregoing and other objects in view there is provided, in accordance with the invention, a SUB-D shielded plug connector for mounting at right angles to a printed circuit board, comprising:

- a one-piece or multi-piece insulating body holding contacts of the plug connector;
- a metallic shield cage enclosing the insulating body, the shield cage including
  - a planar cover wall with edges and a turret-like lead-in plate produced by deep-drawing disposed on the cover wall;
  - sidewalls formed on the edges of the cover wall and bent downwardly away from the cover wall by substantially 90° with respect to the cover wall, reaching substantially to a printed circuit board on which the plug connector is to be mounted, and laterally enclosing the insulating body;
- the metallic shield cage with the lead-in plate, the cover wall, and the sidewalls being integrally formed of a sheet-metal part, whereby the cover wall and the sidewalls together form a box-shaped cavity; and

- the insulating body being accommodated completely in the cavity, being shielded by the shield cage except on an insertion side and a bottom side thereof facing the printed circuit board, and being held in a fixed position between the printed circuit board and the shield cage.

In other words, the novel features of the connector according to the invention may be summarized as follows:

a) on the edges of the cover wall, sidewalls are bent through 90° with respect to the cover wall, extend as far as the printed circuit board, and enclose the insulating body at the sides;

b) the metallic shield cage, together with the lead-in plate, cover wall and sidewalls, is composed of an integral sheet-metal part, in which the cover wall and the sidewalls bent from it form a cavity in the form of a box;

c) the insulating body is accommodated completely in the cavity, is shielded except for the insertion side and the lower side which is opposite the insertion side and faces the printed circuit board, and is held in a fixed position between the printed circuit board and the shield cage.

In accordance with an added feature of the invention, two mutually opposite sidewalls of the shield cage are formed with cut-out sheet-metal lugs and the sheet-metal lugs are clipped onto the insulating body.

In accordance with an additional feature of the invention, the cover wall has two holes formed therein laterally of the lead-in plate, and including attachment elements for extending through the holes and attaching the shield cage to the printed circuit board.

In accordance with another feature of the invention, the attachment elements are screws passing through the holes and through the printed circuit board.

In accordance with a further feature of the invention, the sidewalls of the shield cage have edges facing the printed circuit board, the edges being formed with projecting, rigid teeth.

In accordance with an alternative embodiment, the edges are formed with spring elements.

In accordance with yet another feature of the invention, the edges are formed with solder pins or push-in pins projecting towards the printed circuit board.

In accordance with a concomitant feature of the invention, a contact plate supports the shield cage on the printed circuit board.

The fact that the metallic shield cage of the plug connector is composed of an integral sheet-metal part simplifies the construction of the shield cage and makes it easier to fit the shield cage to the insulating body of the plug connector. The integral sheet-metal part is formed by means of its shape together with the cover wall and the sidewalls bent from it such that a cavity in the form of a box is produced, in which the insulating body is held and enclosed. Since the shield cage with its sidewalls also extends as far as the printed circuit board, this ensures effective electromagnetic shielding, which surrounds the insulating body and the contacts held therein on all sides, from the environment.

Other features which are considered as characteristic for the invention are set forth in the appended claims.

Although the invention is illustrated and described herein as embodied in a shielded plug connector, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

BRIEF DESCRIPTION OF THE INVENTION

FIG. 2 is a perspective view of a metallic shield cage forming the shielding;

FIG. 3 is a partly sectional view through a printed circuit board with the novel plug connector attached thereto and shown in elevation;

FIGS. 4, 5 and 6 are perspective views of various embodiments of the edge of the shield cage facing a printed circuit board, with FIG. 5A showing a detail section along the line A—A in FIG. 5.

DESCRIPTION OF THE PREFERRED EMBODIMENTS

Figure 1:
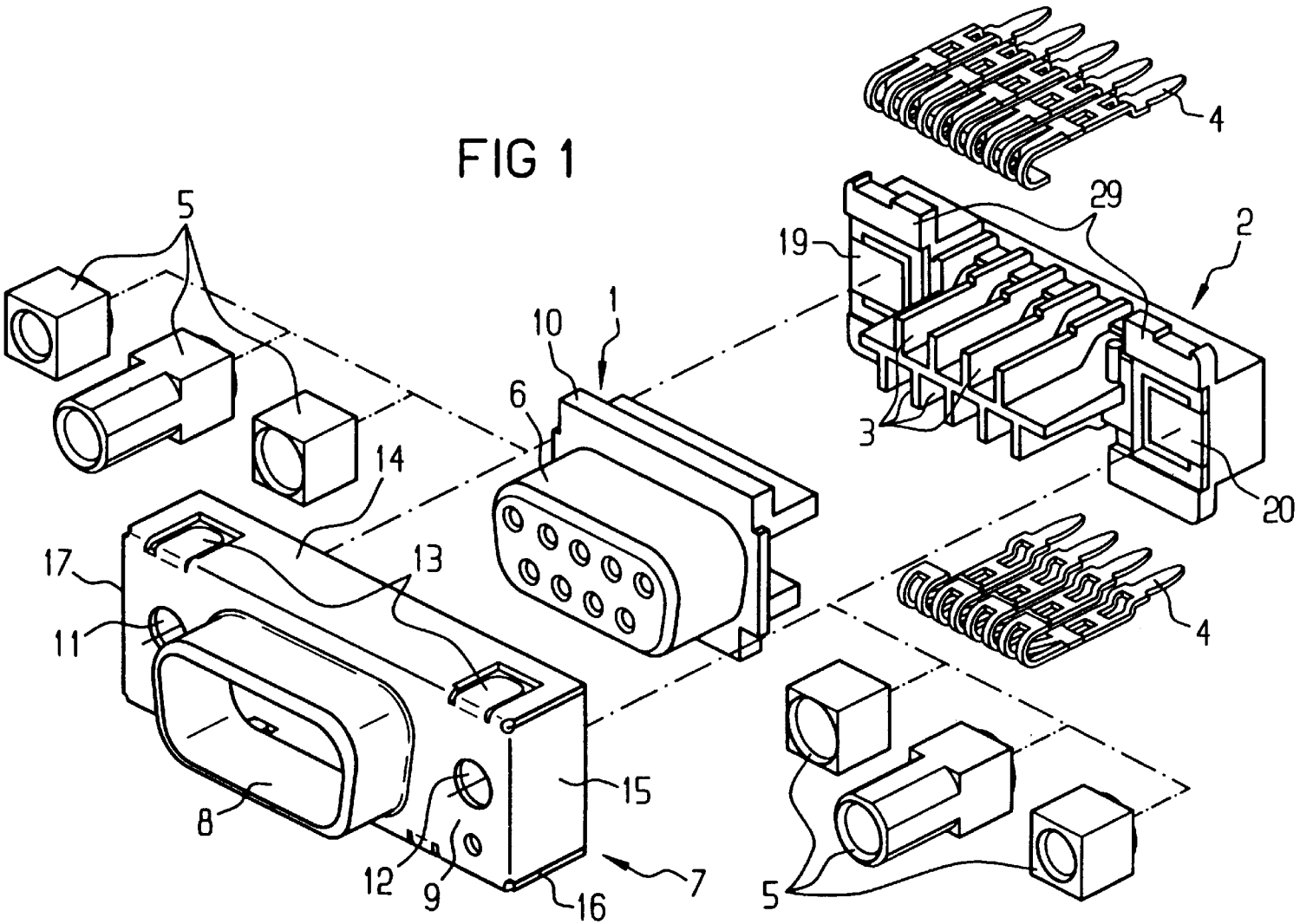
FIG. 1 is an exploded, perspective view of a novel plug connector in the form of a female connector strip, showing its individual parts and its shielding.

Referring now to the figures of the drawing in detail and first, particularly, to FIG. 1 thereof, there is seen a plug connector in a sub-miniature configuration. These connectors are generally referred to as SUB-D plug connectors. In contrast to angled plug connectors, the plug connector is in this case straight, that is to say it is designed to be suitable for vertical fitting on a printed circuit board 18, so that the insertion direction, and thus the contacts of the plug connector, are directed at right angles to the printed circuit board (see FIGS. 3, 8). The plug connector according to FIG. 1 has an insulating body for a female or male connector strip. The insulating body is formed by an outer insulating part 1 and an inner insulating part 2 which can be held in it and, on two mutually opposite sides, has chambers 3 for contacts 4, for example contact springs of a female connector strip. Attachment elements 5 are provided for attaching the plug connector to a printed circuit board 18. A metallic shield cage 7, which is composed of an integral sheet-metal part, is provided as the shielding which surrounds the insulating body 1, 2 on all sides except for the insertion side and the lower side facing the printed circuit board. The metallic shield cage 7 has a shape which matches that of a turret-like lead-in plate 8 which surrounds the turret-like upper part 6 of the insulating part 1 on its outer casing. The lead-in plate 8 is produced by deep-drawing. At the end of the lead-in plate facing away from the insertion side, the cage 7 is formed with a planar cover wall 9, parallel to the printed circuit board 18. The cover wall 9 has a size such that, when installed, it entirely covers the plate 10, which supports the upper part 6, of the insulating part 1 and the plate 29 of the insulating part 2. In addition, the cover wall 9 of the shield cage 7 is formed to the side of the lead-in plate 8 with two holes 11, 12, through which the attachment elements 5 can be passed in order to attach the plug connector on the printed circuit board to a mating connector or to a chassis. Furthermore, four side parts are integrally formed on the edges of the cover wall 9 and are bent through 90° with respect to the cover wall 9. The four side parts form sidewalls 14, 15, 16 and 17 which enclose the insulating body 1, 2 laterally at the sides. The sidewalls are sufficiently long that they extend all the way to the printed circuit board 18.

In the illustrated embodiment, the shield cage 7 is formed with two cut-out sheet-metal lugs 13 each on two mutually opposite sidewalls, in this case on the longer sidewalls 14 and 16. The sheet-metal lugs 13 are bent inward and are connected to the insulating body 1, 2 by clipping around the plate 29 of the insulating part 1 at the sides. The insulating body 1, 2 and the shield cage 7 pushed onto it are thus connected to one another in a simple manner.

In all the embodiments of the shield cage, its sidewalls 14 to 17 are designed such that the insulating body, with its two insulating parts 1 and 2 (or as an integral male connector strip), are held completely in the closed cavity, which is in the form of a box, in the shield cage. It is thus intrinsically sufficient—as is illustrated in FIG. 3—for the entire plug connector to be attached to the printed circuit board 18 just by means of screws 21 and nuts 22. The screws 21 pass through the holes 11, 12 in the shield cage and through holes 19, 20 in the insulating part 2. The insulating body 1, 2 is thereby held in a fixed position between the printed circuit board and the shield cage. Furthermore, it may also be expedient if the shield cage can be pushed onto the insulating body 1, 2, with a good fit. As can be seen in FIG. 3, the shield cage 7 is attached directly to the printed circuit board, the edges of the sidewalls 14 to 17 of the shield cage 7 being located at least very close above the printed circuit board 18, or alternatively being able to touch it directly and thus making it possible to produce a direct electrical connection between the shield cage and the surface of the printed circuit board.

However, in order reliably to ensure the ground contact between the shield cage and the printed circuit board in a simple and reliable manner, it is advantageous if—as can be seen in the embodiment of the shield cage 7*a* illustrated in FIG. 4—those edges of the sidewalls 14 to 17 of the shield cage 7*a* which face the printed circuit board 18 are formed with projecting, rigid teeth 23. The teeth 23 are preferably arranged at uniform distances from one another and form a multiplicity of contact points with the printed circuit board. A corresponding printed circuit board surface composed of electrically conductive material is a precondition for this.

Instead of rigid contact points, the edges facing the printed circuit board 18 can be provided with spring elements 24 as in the case of the shield cage 7*b* in FIG. 5. These spring elements 24 are formed, for example, by feathering of the sidewalls or by the sidewalls 14 to 17 of the shield cage 7*b* being provided (preferably at uniform distances from the edge) with a short incision 25 and with spring flaps 26 (detail FIG. 5A) which are bent inward through somewhat less than 90°. In this way, a plurality of contact points which rest in a sprung manner against the printed circuit board are formed, so that reliable contact is ensured between the shield cage 7*b* and a printed circuit board 18, even in the event of variations within tolerance.

Figure 6:
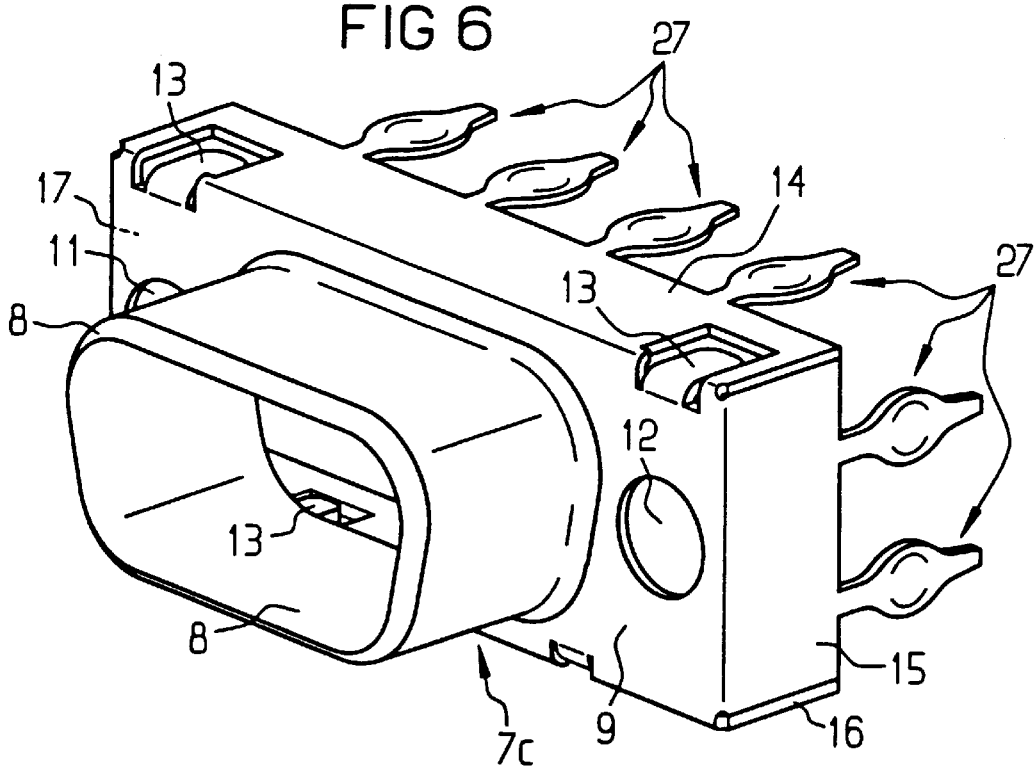

Furthermore, as in the case of the shield cage 7*c* in FIG. 6, it is possible to provide integrally formed pins 27, which project in the direction of the printed circuit board, on those edges of the sidewalls 14 to 17 of this shield cage which face the printed circuit board 18. The pins 27 are plugged into corresponding holes in the printed circuit board. The pins 27 are preferably soldered into the printed circuit board holes or are designed, in a preferred manner, as push-in pins and are then pushed into the printed circuit board holes, without being soldered. In either case, this attachment process can be carried out during the process of producing (connection and making contact with) the signal contacts.

Figure 7:
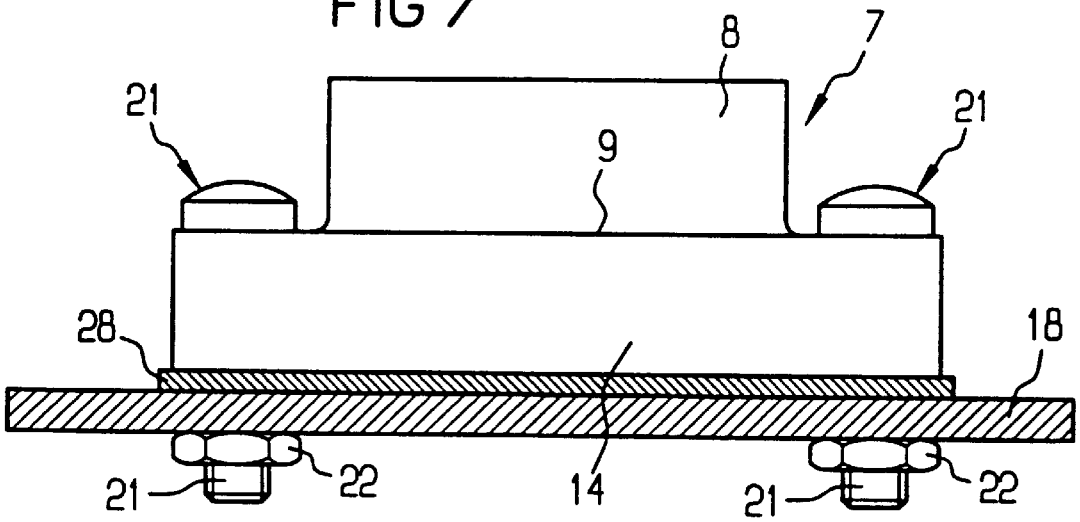
FIG. 7 is a partly sectional view through a printed circuit board with an alternative attachment of the novel plug connector to the printed circuit board.

Finally, FIG. 7 shows another option for attaching the plug connector to a printed circuit board 18. In this case, the shield cage 7 and, with it, the entire plug connector, are fixed on the printed circuit board by means of a screw attachment. A contact plate 28 is arranged as an intermediate layer between the printed circuit board 18 and the shield cage 7, so that the shield cage makes indirect contact with the printed circuit board.

In all the embodiments, the shield cage is composed of an integral sheet-metal part which is designed and disposed on the printed circuit board such that the insulating body which is held in the shield cage (e.g. a male connector strip) is held in a fixed position between the printed circuit board and the shield cage and—except for the free insertion side—is electromagnetically shielded on all sides and all round.

As a modification to the illustrated embodiment, it is also possible to provide other types of attachment for attaching the plug connector to the printed circuit board or to a chassis, or for the connection to a mating connector. Suitable connections include soldered, push-in, and snap-in connections. In the illustrated screw attachment, the ground contact is preferably made via a contact-pressure contact, but it can also be produced directly via the attachment elements themselves.

We claim:

1. A SUB-D shielded plug connector for mounting at right angles to a printed circuit board, comprising:

an insulating body holding contacts of the plug connector;

a metallic shield cage enclosing said insulating body, said shield cage including a planar cover wall with edges and a turret-like lead-in plate produced by deep-drawing disposed on said cover wall;

sidewalls formed on the edges of said cover wall and bent downwardly away from said cover wall by substantially 90° with respect to said cover wall, reaching substantially to a printed circuit board on which the plug connector is to be mounted, and laterally enclosing said insulating body;

said metallic shield cage with said lead-in plate, said cover wall, and said sidewalls being integrally formed of a sheet-metal part, whereby said cover wall and said sidewalls together form a box-shaped cavity; and said insulating body being accommodated completely in said cavity, being shielded by said shield cage except on an insertion side and a bottom side thereof facing the printed circuit board, and being held in a fixed position between the printed circuit board and said shield cage.

2. The plug connector according to claim 1, wherein said insulating body is a one-piece insulating body.

3. The plug connector according to claim 1, wherein said insulating body is a multi-piece insulating body.

4. The plug connector according to claim 1, wherein two mutually opposite sidewalls of said sidewalls of said shield cage are formed with cut-out sheet-metal lugs and said sheet-metal lugs are clipped onto said insulating body.

5. The plug connector according to claim 1, wherein said cover wall has two holes formed therein laterally of said lead-in plate, and including attachment elements for extending through said holes and attaching said shield cage to the printed circuit board.

6. The plug connector according to claim 1, wherein said attachment elements are screws passing through said holes and through the printed circuit board.

7. The plug connector according to claim 1, wherein said sidewalls of said shield cage have edges facing the printed circuit board, said edges being formed with projecting, rigid teeth.

8. The plug connector according to claim 1, wherein said sidewalls of said shield cage have edges facing the printed circuit board, said edges being formed with spring elements.

9. The plug connector according to claim 1, wherein said sidewalls of said shield cage have edges facing the printed circuit board, said edges being formed with solder pins projecting towards the printed circuit board.

10. The plug connector according to claim 1, wherein said sidewalls of said shield cage have edges facing the printed circuit board, said edges being formed with push-in pins projecting towards the printed circuit board.

11. The plug connector according to claim 1, which further comprises a contact plate disposed between said shield cage and the printed circuit board.

* * * * *